US008820457B2

(12) United States Patent
Nishimura

(10) Patent No.: US 8,820,457 B2
(45) Date of Patent: Sep. 2, 2014

(54) HYDRAULIC EXCAVATOR

(71) Applicant: Komatsu Ltd., Tokyo (JP)

(72) Inventor: Minetaka Nishimura, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/990,897

(22) PCT Filed: Nov. 13, 2012

(86) PCT No.: PCT/JP2012/079382

§ 371 (c)(1),
(2), (4) Date: May 31, 2013

(87) PCT Pub. No.: WO2014/076761

PCT Pub. Date: May 22, 2014

(65) Prior Publication Data

US 2014/0133949 A1 May 15, 2014

(51) Int. Cl.
*E02F 9/26* (2006.01)
*E02F 9/08* (2006.01)

(52) U.S. Cl.
CPC ..... *E02F 9/0858* (2013.01)
USPC ..... 180/89.13; 37/348

(58) Field of Classification Search
CPC ..... E02F 1/00; E02F 3/00; E02F 5/00; E02F 7/00; E02F 9/00; E02F 9/264; E02F 9/267; H01Q 1/3275
USPC ..... 180/89.13
See application file for complete search history.

(56) References Cited

U.S. PATENT DOCUMENTS

| | | | | |
|---|---|---|---|---|
| 5,438,771 | A * | 8/1995 | Sahm et al. | 37/348 |
| 6,782,644 | B2 * | 8/2004 | Fujishima et al. | 37/348 |
| 7,640,683 | B2 * | 1/2010 | McCain | 37/348 |
| 2003/0147727 | A1 * | 8/2003 | Fujishima et al. | 414/200 |
| 2004/0020083 | A1 * | 2/2004 | Staub et al. | 37/348 |
| 2010/0033388 | A1 * | 2/2010 | Miller et al. | 343/715 |
| 2013/0166143 | A1 * | 6/2013 | Seki | 701/34.4 |

FOREIGN PATENT DOCUMENTS

| | | | |
|---|---|---|---|
| JP | 2007-327190 | A | 12/2007 |
| JP | 2008-102097 | A | 5/2008 |
| JP | 2009-138375 | A | 6/2009 |

* cited by examiner

*Primary Examiner* — Paul N Dickson
*Assistant Examiner* — Darlene P Condra
(74) *Attorney, Agent, or Firm* — Global IP Counselors, LLP

(57) ABSTRACT

A hydraulic excavator basically includes a counterweight, an engine compartment, an equipment compartment, a cab, a plurality of steps, a passage and a pair of antenna supporting parts for supporting a pair of GNSS antennas, respectively. The antenna supporting parts are positioned ¼ or more of the vehicle width away from the revolving center and are positioned closer to the revolving center than a left rear edge of the passage. The left rear edge of the passage is the position furthest away from the revolving center of the steps and the passage.

19 Claims, 6 Drawing Sheets

HYDRAULIC EXCAVATOR

BACKGROUND

1. Field of the Invention

The present invention relates to a hydraulic excavator that can be equipped with a GLASS antenna.

2. Background Information

A hydraulic excavator equipped with a pair of antennas for a Real Time Kinematic-Global Navigation Satellite System (RTK-GNSS) is known in the prior art (e.g., see Japanese Patent Laid-open No. 2008-102097). The pair of antennas is installed on a counterweight.

SUMMARY

However, when the pair of antennas is installed on the counterweight, the antennas undergo a large amount of acceleration accompanying the stopping and starting of rotation since the antennas are positioned far away from the revolving center of all upper revolving unit. Consequently, the antennas are more likely to break down.

In light of this problem, an object of the present invention is to provide a hydraulic excavator that allows for a more stable antenna operation.

A hydraulic excavator according to a first embodiment of the present invention comprises a lower driving unit, an upper revolving unit, a counterweight, a machine compartment, a cab, a passage, a steps, and a pair of antenna supporting parts for supporting a pair of antennas. The upper revolving unit is revolvably mounted on the lower driving unit. The counterweight is disposed on the upper revolving unit. The machine compartment is disposed in front of the counterweight on the upper revolving unit. The cab is disposed in front of the machine I compartment on the upper revolving unit. The passage is formed on the machine compartment. The steps is connected to the machine compartment and leads to the passage. The antenna pair supporting part is positioned ¼ or more of a vehicle width from a revolving center of the upper revolving unit, and closer to the revolving center than a position furthest away from the revolving center of the passage and the steps when viewed from above.

According to the hydraulic excavator according to the first embodiment of the present invention, the pair of antennas can be disposed closer to the revolving center than a case in which the pair of supporting parts is disposed on the counterweight. As a result, a first and a second GNSS antenna can be operated in a stable manner since acceleration applied to the first and second GNSS antennas is reduced at the start and finish of rotation of the upper revolving unit. Moreover, the pair of antennas can be disposed further away from each other than a case in which each of the antenna supporting parts are disposed close to each other within ¼ of the vehicle width. As a result, a precision in positioning of a revolving center in a global coordinate, which is calculated on the basis of information received by the pair of antennas, can be improved.

A hydraulic excavator according to a second embodiment of the present invention is related to the first embodiment, and the pair of antenna supporting parts is positioned on the machine compartment, the cab, or the steps when viewed from above.

According to the hydraulic excavator according to the second embodiment of the present invention, contact of the pair of antennas with obstructions and the like can be avoided since the pair of antenna supporting parts do not protrude to the outside of the hydraulic excavator.

The hydraulic excavator according to a third embodiment of the present invention is related to the first and second embodiments, and further comprises a pair of handrails disposed on the machine compartment. The pair of antenna supporting parts is connected to the pair of handrails.

According to the hydraulic excavator according to the third embodiment of the present invention, there is no need to increase the size of the pair of antenna supporting parts in order to place the pair of antennas in higher positions. As a result, the pair of antenna supporting parts can be made in a compact manner.

The hydraulic excavator according to a fourth embodiment of the present invention is related to the first and second embodiments, and further comprises a pair of handrails disposed on the machine compartment. The pair of antenna supporting parts is a portion of the pair of handrails, According to the hydraulic excavator to the fourth embodiment of the present invention, there is no need to increase the size of the pair of antenna supporting parts in order to place the pair of antennas in higher positions. As a result, the pair of antenna supporting parts can be made in a compact manner.

A hydraulic excavator to a fifth embodiment of the present invention is related to the third embodiment, and the pair of antenna supporting parts is positioned on a side opposite to the passage relative to the pair of handrails when seen from above.

According to the hydraulic excavator to the fifth embodiment of the present invention, an operator can recognize that the pair of antenna supporting parts is not the handrails. Therefore, there is no need to improve the strength of the pair of antenna supporting parts as much as the handrails.

The hydraulic excavator to a sixth embodiment of the present invention is related to the first to fifth embodiments, and further comprises a pair of antennas removably attached to the pair of antenna supporting parts.

According to the hydraulic excavator to the sixth embodiment of the present invention, the operator can easily attach or detach the pair of antennas at the start or completion of work.

A hydraulic excavator to a seventh embodiment of the present invention is related to the first to sixth embodiments, and the machine compartment includes an engine compartment disposed in front of the counterweight, and an equipment compartment disposed in front of the engine compartment. The passage is formed on the equipment compartment. The steps are disposed in front of the equipment compartment.

According to the present invention, a hydraulic excavator that enables an improvement in precision of position coordinate measurement can be provided.

DESCRIPTION OF EMBODIMENTS

Figure 1:
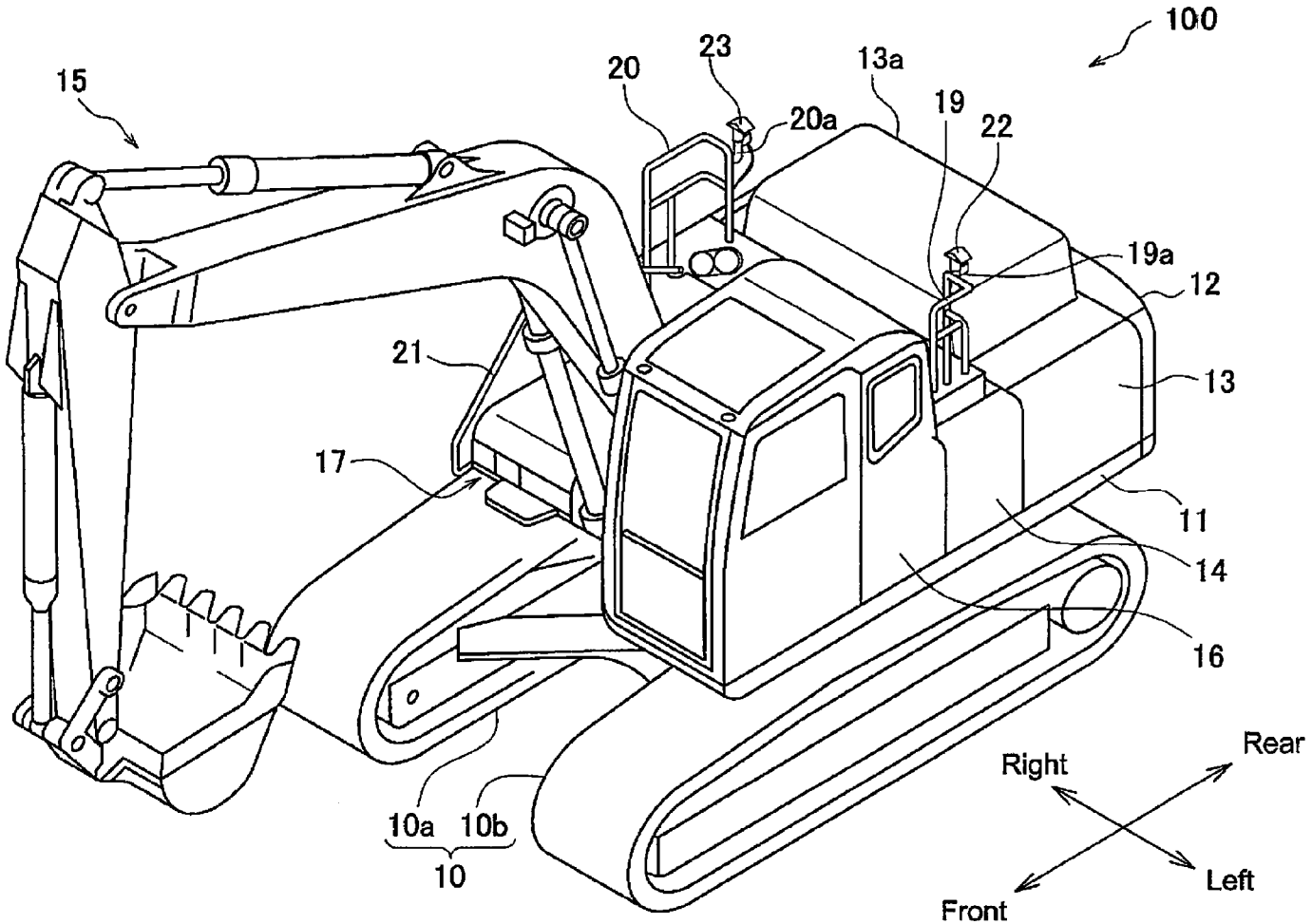
FIG. 1 is a frontal perspective view of a hydraulic excavator.

Next, an embodiment of the present invention will be explained with reference to the drawings. In the following description of the drawings, identical or similar parts are given identical or similar reference numerals. However, the drawings are schematic and dimensional ratios and the like may differ from the actual objects. Therefore, detailed dimensions and the like should be determined in consideration of the following drawings. Moreover, it is needless to say that parts with mutually different dimensional relationships or ratios are included in mutual relationships in the drawings.

In the following description, "up," "down," "front," "rear," "left," and "right" are terms used on the basis of an operator sitting in the drivers seat.

Figure 2:
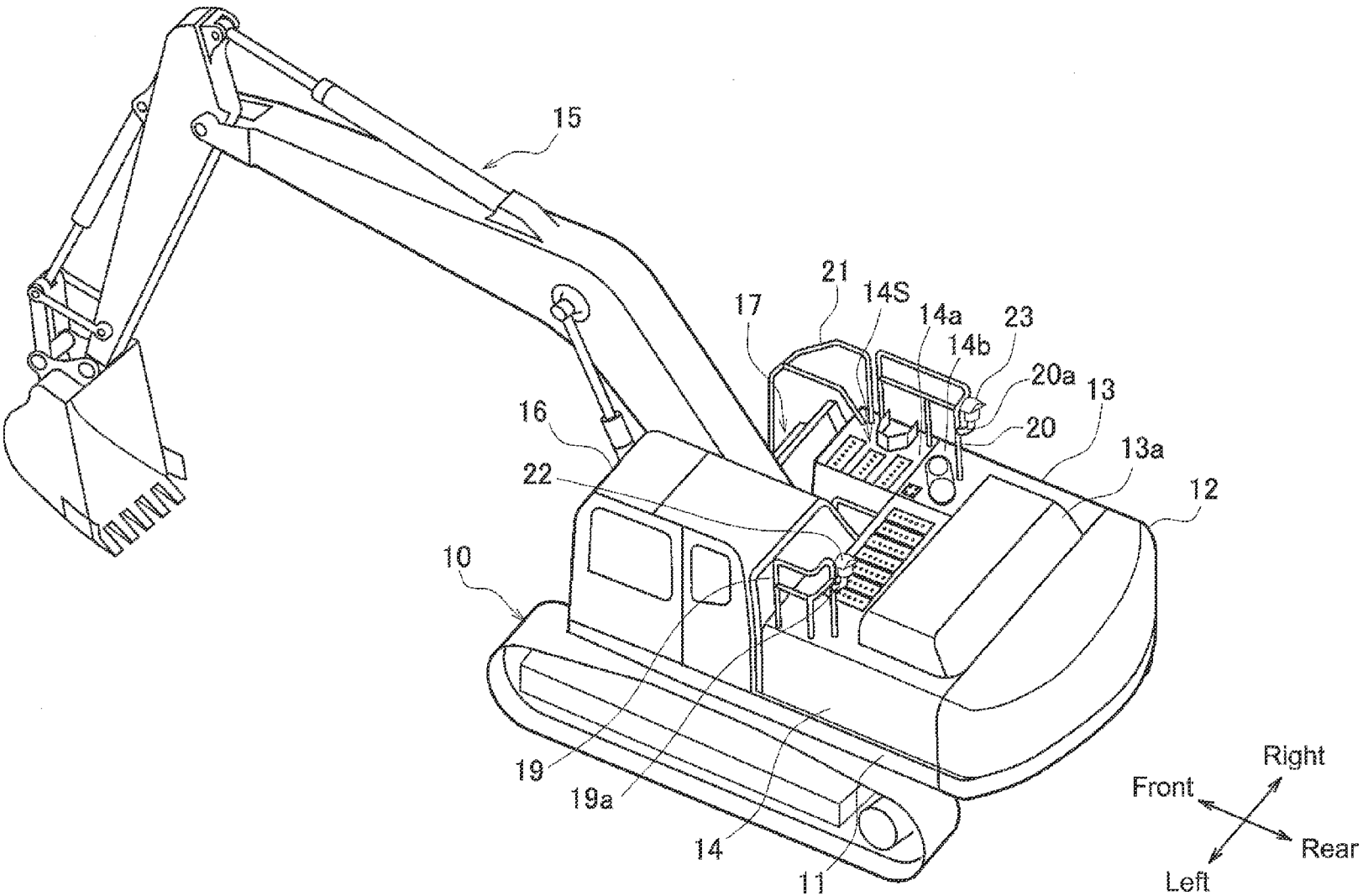
FIG. 2 is a rear perspective view of the hydraulic excavator.

A configuration of a hydraulic excavator 100 according to an embodiment shall be explained in detail with reference to the drawings. FIG. 1 is a front perspective view of the hydraulic excavator 100. FIG. 2 is a rear perspective view of the hydraulic excavator 100.

The hydraulic excavator 100 includes a lower driving unit 10, an upper revolving unit 11, a counterweight 12, an engine compartment 13, an equipment compartment 14, a work implement 15, a cab 16, a steps 17, a first handrail 19, a second handrail 20, a third handrail 21, a first GNSS antenna 22, and a second GNSS antenna 23.

The lower driving unit 10 includes a pair of rotatable crawlers 10*a*, 10*b* that operate independently of each other. The hydraulic excavator 100 moves back and forth and left and right by rotating the pair of crawlers 10*a*, 10*b*.

The upper revolving unit 11 is mounted in a rotatable manner on the lower driving unit 10. The upper revolving unit 11 is able to rotate around a revolving center CP (see FIG. 3) that is parallel to the vertical direction. The upper revolving unit 11 constitutes the vehicle body frame of the hydraulic excavator 100. The counterweight 12, the equipment compartment 14, the engine compartment 13, and the cab 16 are disposed on the upper revolving unit 11

The counterweight 12 is disposed at the rearmost side of the upper revolving unit 11. The counterweight 12 is formed by inserting waste steel or concrete into a box assembled from steel plates. The counterweight 12 is used to maintain balance while doing excavation work and the like.

The engine compartment 13 is disposed on the upper revolving unit 11. The engine compartment 13 is disposed in front of the counterweight 12. The engine compartment 13 is disposed behind the equipment compartment 14. The engine compartment 13 accommodates an engine and an exhaust gas treatment device and the like that are not illustrated in the drawings. An engine hood 13 that can be opened and closed is disposed above the engine compartment 13. The operator can stand on a passage 18 and open the engine hood 13 when conducting maintenance inside the engine compartment 13.

The equipment compartment 14 is disposed between the engine compartment 13 and the work implement 15 on the upper revolving unit 11. The equipment compartment 14 includes a fuel tank 14*a* and an operating fluid tank 14*b*. In the present embodiment, an upper surface 14S of the equipment compartment 14 is formed in an L shape as illustrated in FIG. 2.

In the present embodiment, the engine compartment 13 and the equipment compartment 14 constitute a machine compartment upon which the passage 18 is formed.

The work implement 15 is mounted in a swingable manner at the front side of the upper revolving unit 11. The work implement 15 is disposed in front of the equipment compartment 14. The work implement 15 is supported by the upper revolving unit 11 between the cab 16 and the steps 17.

The cab 16 is disposed on the upper revolving unit 11. The cab 16 is provided in front of the equipment compartment 14 and to the left of the work implement 15 to allow the operator to view the movement of the work implement 15. An operator's seat in which the operator sits is provided inside the cab 16.

The steps 17 are used for climbing up and down between ground and the passage 18. The steps 17 are connected to the front right of the equipment compartment 14. The steps 17 leads to the front right of the passage 18. The steps 17 include a first step 17*a* and a second step 17*b*. The operator can climb up to the passage 18 by stepping onto the first step 17*a* and the second step 17*b* in succession.

The passage 18 is formed on the equipment compartment 14. The passage 18 is a substantially flat area of the upper surface 14S of the equipment compartment 14. In other words, the passage 18 is an area where the operator can place his feet on the upper surface 14S of the equipment compartment 14. The passage 18 according to the present embodiment is formed in an L shape in accordance with the shape of the upper surface 14S of the equipment compartment 14. A non-slip treatment is applied to the surface of the passage 18. Specifically, a plurality of half-spherical protrusions is formed on the surface of the passage 18. The non-slip treatment may be provided over the entire surface of the passage 18.

The first and second handrails 19, 20 are disposed on the equipment compartment 14. The first and second handrails 19, 20 are provided at the edges of the passage 18 and are used by the operator standing on the passage 18 to support his body. The first handrail 19 and the second handrail 20 are separated from each other in the crosswise direction. Thus, the operator standing between the first handrail 19 and the second handrail 20 is able to open the engine hood 13 to conduct maintenance inside the engine compartment 13. The first handrail 19 is disposed on the left end of the equipment compartment 14. The second handrail 20 is disposed on the right end of the equipment compartment 14. The second handrail 20 is disposed to straddle the fuel tank 14*a* and the operating fluid tank 14*b*.

In the present embodiment, both the first and second handrails 19, 20 take the form of an L shape when viewed from above. Specifically, when seen from above, one side of each L shape extends respectively along the left and right side edges of the upper revolving unit 11, and the other side of each L shape extends respectively from the end of the one side toward the inside of the upper revolving unit 11.

A first antenna supporting part 19*a* is connected to the first handrail 19. The first antenna supporting part 19*a* is a bracket for mounting the first GNSS antenna. 22. Similarly, a second antenna supporting part 20*a* is connected to the second handrail 20. The second antenna supporting part 20*a* is a bracket for mounting the second GNSS antenna 23. Disposition and configuration of the first and second antenna supporting parts 19*a*, 20*a* are explained below.

The third handrail 21 is disposed in front of the first handrail 19 and to the right of the steps 17. The third handrail 21 is used by the operator to support his body while climbing up and down the steps 17.

The first and second GNSS antennas 22, 23 are antennas used for a real time kinematic-global navigation satellite system (RTK-GNSS). The first GNSS antenna 22 is mounted onto the first antenna supporting part 19*b* on the first handrail 19. The second GNSS antenna 22 is mounted onto the second antenna supporting part 20*b* on the second handrail 20. The hydraulic excavator 100 may calculate a global coordinate of the revolving center CP of the upper revolving unit 11 on the basis of information included in satellite radio waves received by both of the first and second GNSS antennas 22, 23. The position precision of the global coordinates is generally becomes better in correspondence with the first and second GNSS antennas 22, 23 being closer to the revolving center CP.

(Disposition of First and Second Antenna Supporting Parts 19*a*, 20*a*)

Figure 3:
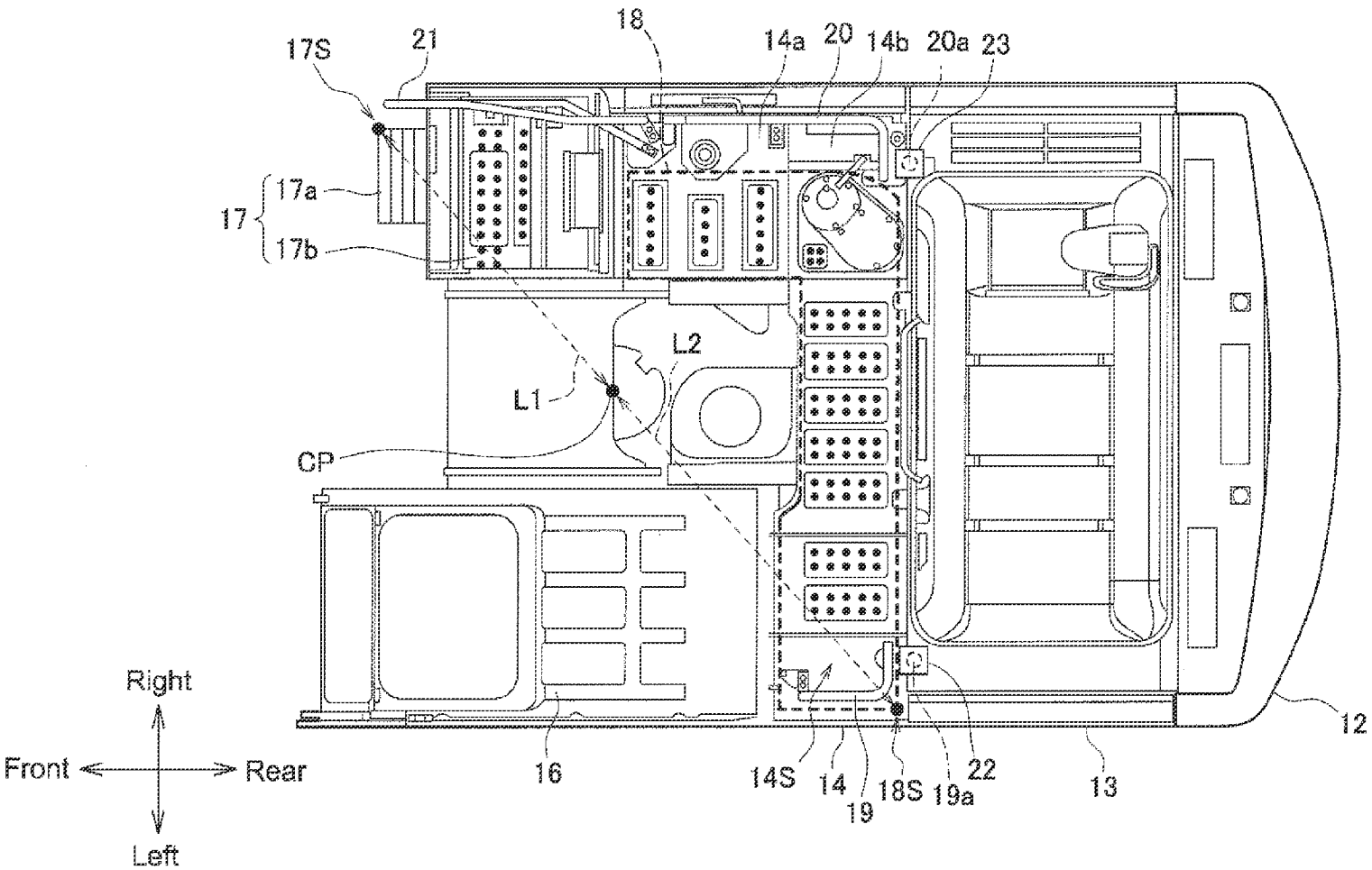
FIG. 3 is a top view of an equipment compartment.
Figure 4:
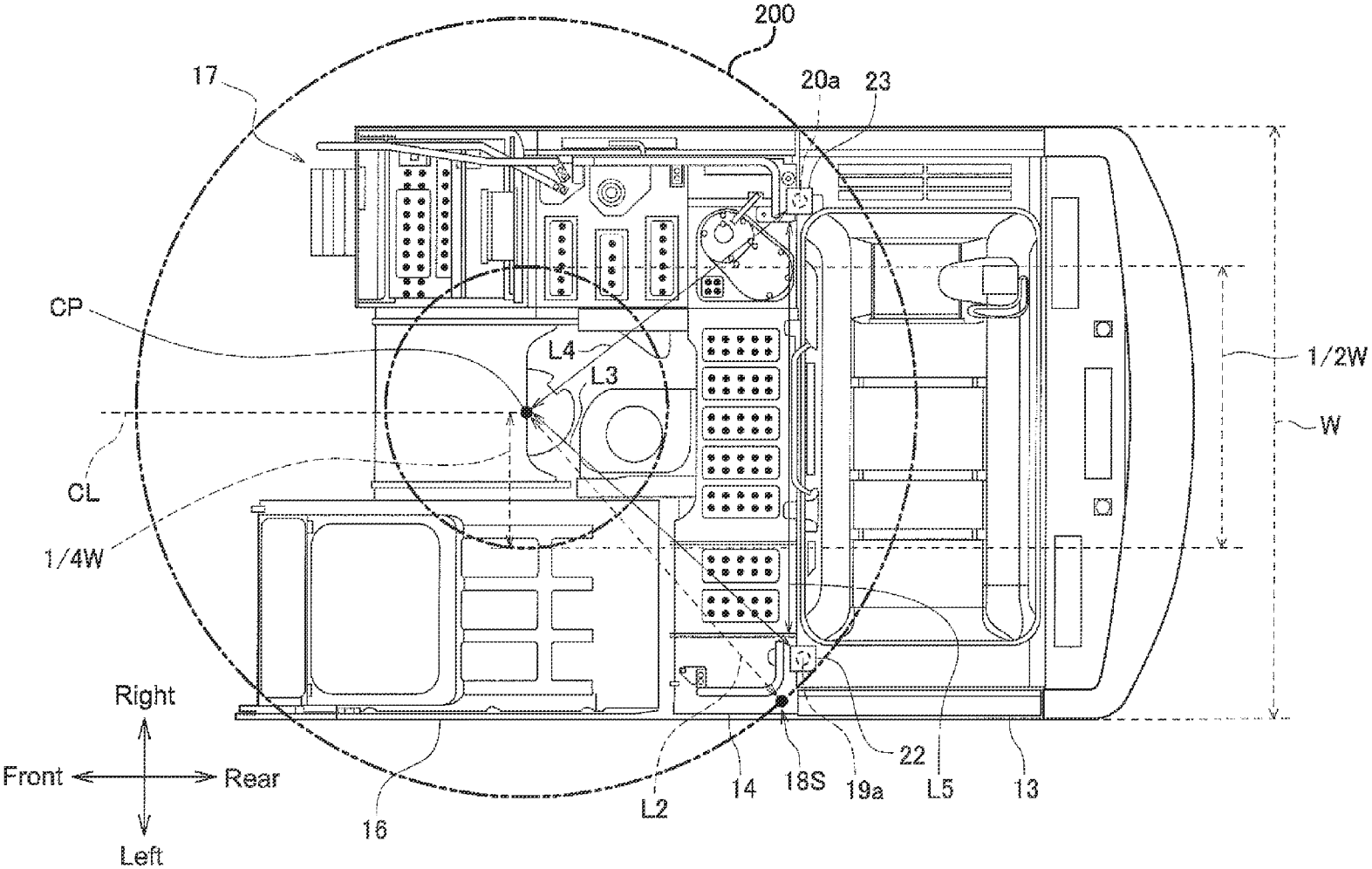
FIG. 4 is a top view illustrating a disposition region of a pair of antenna supporting parts.

Next, the disposition of first and second antenna supporting parts 19*a*, 20*a* is explained with reference to the drawings. FIG. 3 is a top view of the equipment compartment 14. FIG. 4 is a top view illustrating a disposition area 200 (shaded portion of FIG. 4) of the first and second antenna supporting parts 19*a*, 20*a*.

First, the configuration of the steps 17 and the passage 18 will be described with reference to FIG. 3.

The steps 17 lead to the right front of the passage 18. The second step 17*b* is disposed in front of the passage 18, and the first step 17*a* is disposed in front of the second step 17*b*. The position of the steps 17 furthest removed from the revolving center CP is a right front edge 17S. The passage 18 extends in an L shape from the rear of the steps 17. The position of the passage 18 furthest removed from the revolving center CP is a left rear edge 18S. A first interval L1 between the right front edge 17S of the steps 17 and the revolving center CP is smaller than a second interval L2 between the left rear edge 18S of the passage 18 and the revolving center CP. Therefore, in the present embodiment, the position furthest away from the revolving center CP of the steps 17 and the passage 18 is the left rear edge 18S of the passage 18.

Next, the disposition of first and second antenna supporting parts 19*a*, 20*a* is explained with reference to FIGS. 3 and 4.

As illustrated in FIG. 3, the first and second antenna supporting parts 19*a*, 20*a* are respectively connected to the first and second handrails 19, 20. The first and second antenna supporting parts 19*a*, 20*a* are disposed to the right and left of a center line CL. In the present embodiment, the first and second antenna supporting parts 19*a*, 20*a* are positioned with: left-right symmetry relative to the center line CL. The first and second antenna supporting parts 19*a*, 20*a* are respectively positioned to the rear of the first and second handrails 19, 20. The first and second antenna supporting parts 19*a*, 20*a* are respectively positioned to the rear of the passage 18. In other words, the first and second antenna supporting parts 19*a*, 20*a* on the side opposite to the passage relative to the first and second handrails 19, 20. In the present embodiment, the first and second antenna supporting parts 19*a*, 20*a* are positioned on a boundary line between the engine compartment 13 and the equipment compartment 14.

As illustrated in FIG. 4, the first and second antenna supporting parts 19*a*, 20*a* are disposed at positions removed from the revolving center CP by a certain interval. Specifically, the first and second antenna supporting parts 19*a*, 20*a* are disposed inside the disposition area 200. The disposition area 200 is set in an annular manner when viewed from above. The disposition area 200 is an area removed from the revolving center CP by ¼ or more of the vehicle width W, and closer to the revolving center CP than the left rear edge 18S of the passage 18.

Therefore, a third interval L3 between the first antenna supporting part 19*a* and the revolving center CP is defined by the following equation (1).

$$\frac{1}{4} \leq L3 \leq L2 \quad (1)$$

Similarly, a fourth interval L4 between the second antenna supporting part 20*a* and the revolving center CP is defined by the following equation (2).

$$\frac{1}{4} \leq L4 \leq L2 \quad (2)$$

However, the vehicle width W of the hydraulic excavator 100 is set appropriately in accordance with the vehicle type and function and is assumed to be approximately 2 m to 10 m for example.

In the present embodiment, the first and second antenna supporting parts 19*a*, 20*a* are positioned on a boundary line between the engine compartment 13 and the equipment compartment 14. In this way, the first and second antenna supporting parts 19*a*, 20*a* preferably do not project to the outside of the hydraulic excavator 100. That is, the first and second antenna supporting parts 19*a*, 20*a* are preferably disposed on the engine compartment 13, the equipment compartment 14, the cab 16, or the steps 17. In particular, the first and second antenna supporting parts 19*a*, 20*a* are preferably disposed a certain interval to the inside of the outer edge of the hydraulic excavator 100.

A fifth interval L5 between the first and second antenna supporting parts 19*a*, 20*a* is preferably equal to or greater than ¼ of the vehicle width W, or more preferably equal to or greater than the third interval L3 and the fourth interval L4.

Since the first and second GNSS antennas 22, 23 are respectively mounted onto the first and second antenna supporting parts 19*a*, 20*a*, the disposition positions of the first and second GNSS antennas 22, 23 are similar to the disposition positions of the abovementioned first and second antenna supporting parts 19*a*, 20*a*.

Figure 5:
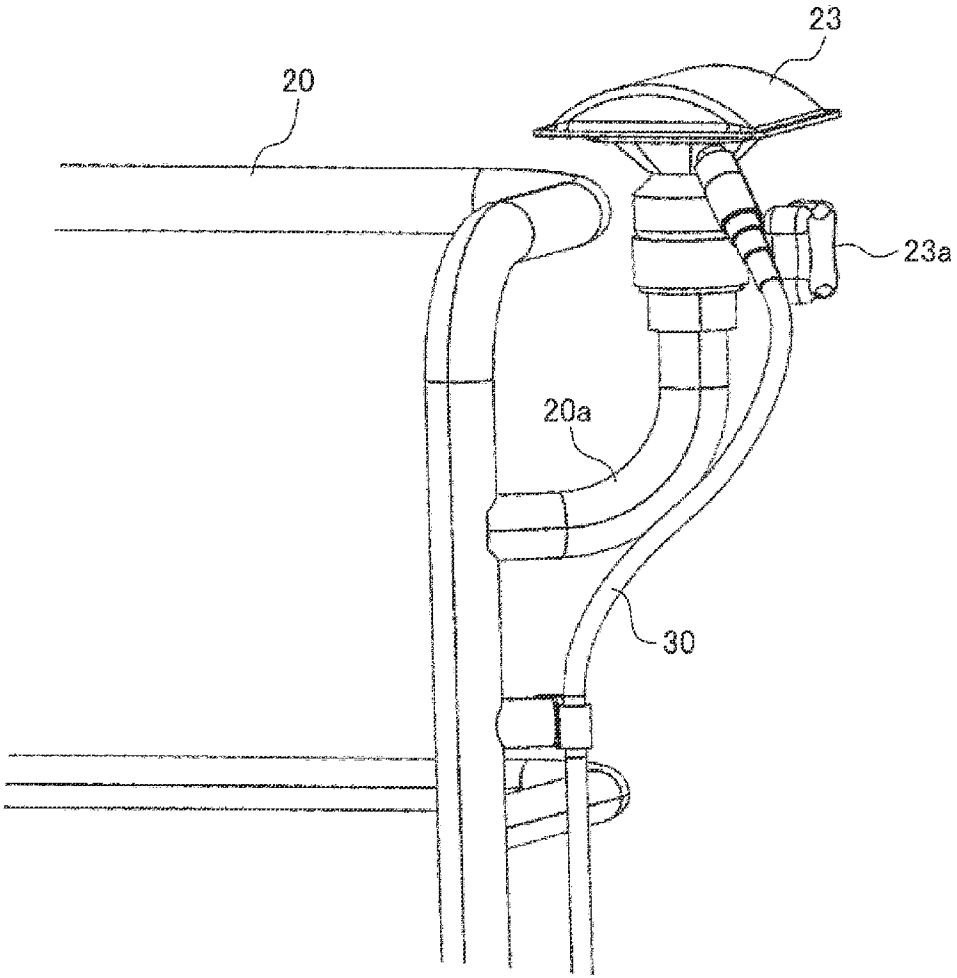
FIG. 5 illustrates a configuration of the pair of antenna supporting parts.
Figure 6:
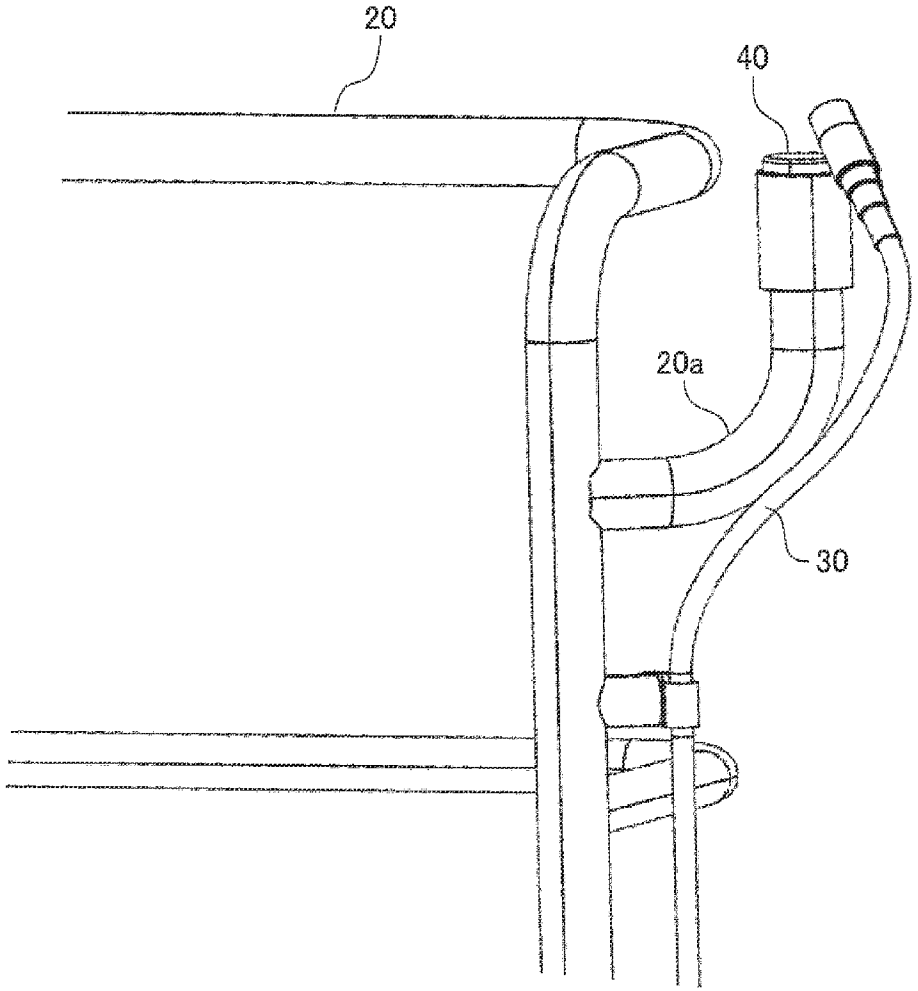
FIG. 6 illustrates a configuration of the pair of antenna supporting parts.

Next, the configuration of the first and second antenna supporting parts 19*a*, 20*a* is explained with reference to the drawings. The following is an explanation of the configuration of the second antenna supporting part 20*a* since the first and second antenna supporting parts 19*a*, 20*a* have the same configuration, FIG. 5 illustrates a condition in which the second GNSS antenna 23 is mounted onto the second antenna supporting part 20*a*. FIG. 6 illustrates a condition in which the second GNSS antenna 23 is removed from the second antenna supporting part 20*a*.

The second antenna supporting part 20*a* is a bracket configured by a circular tube bent into an L shape. The second antenna supporting part 20*a* is disposed to extend rearward and upward from the rear part of the second handrail 20. The second antenna supporting part 20*a* is disposed on the side opposite to the passage 18 with the second handrail 20 interposed therebetween since the passage 18 is in front of the rear part of the second handrail 20. The height of the second antenna supporting part 20*a* is preferably the same height as the second handrail 20.

As illustrated in FIG. 5, the second GNSS antenna 23 is positioned on the second antenna supporting part 20*a*. The second GNSS antenna 23 is preferably disposed in a position higher than the second handrail 20 in order to properly receive GNSS satellite radio waves. The second GNSS antenna 23 has a knob 23*a* for coupling the second GNSS antenna 23 to the second antenna supporting part 20*a*. A cable 30 for transmitting position information to a controller is connected to the second GNSS antenna 23.

The second GNSS antenna 23 is preferably disposed in a position higher than the upper surface of the cab 16 in order to favorably receive GNSS satellite radio waves.

As illustrated in FIG. 6, a cap 40 is fitted onto the second antenna supporting part 20*a* when the second GNSS antenna 23 is removed.

Actions and Effects (1) The first and second antenna supporting parts 19*a*, 20*a* (example of pair of antenna supporting parts) in the present embodiment are positioned ¼ or more of the vehicle width W away from the revolving center CP and are positioned closer to the revolving center CP than the left rear edge 18S of the passage 18. The left rear edge 18S of the passage 18 is the position furthest away from the revolving center CP of the steps 17 and the passage 18.

Therefore, the first and second GNSS antennas 22, 23 can be positioned closer to the revolving center CP than a case in which the first and second antenna supporting parts 19*a*, 20*a* are disposed on the counterweight 12. As a result, the first and second GNSS antennas 22, 23 can be operated in a stable manner since the acceleration applied to the first and second GNSS antennas 22, 23 when the rotation of the upper revolving unit 11 starts or stops can be reduced. The first and second GNSS antennas 22, 23 can be positioned far enough away from each other than a case in which the first and second antenna supporting parts 19*a*, 20*a* are disposed close to each other in an area within ¼ of the vehicle width W. As a result, the global coordinate positioning precision of the revolving center CP calculated on the basis of information received by the first and second GNSS antennas 22, 23 can be improved.

(2) The first and second antenna supporting parts 19*a*, 20*a* are positioned on the boundary line between the engine compartment 13 and the equipment compartment 14.

Therefore, since the first and second antenna supporting parts 19*a*, 20*a* do not project to the outside of the hydraulic excavator 100, contact of the first and second GNSS antennas 22, 23 with obstructions and the like can be reduced.

(3) The first and second antenna supporting parts 19*a*, 20*a* are respectively connected to the first and second handrails 19, 20.

Therefore, there is no need to make the first and second antenna supporting parts 19*a*, 20*a* bigger for placing the first and second GNSS antennas 22, 23 in high positions. As a result, the first and second antenna supporting parts 19*a*, 20*a* can be made in a compact manner.

(4) The first and second antenna supporting parts 19*a*, 20*a* are positioned on the side opposite to the passage 18 relative to the first and second handrails 19, 20.

Therefore, the operator can recognize that the first and second antenna supporting parts 19*a*, 20*a* are not handrails. Thus, there is no need to improve the strength of the first and second antenna supporting parts 19*a*, 20*a* as much as the handrails.

(5) The first and second GNSS antennas 22, 23 (example of a pair of antennas) are respectively mounted in a detachable manner onto the first and second antenna supporting parts 19*a*, 20*a*.

Therefore, the operator is able to easily attach or remove the first and second GNSS antennas 22, 23 when starting or finishing work.

While the present invention has been described with the embodiment provided above, the description and drawings form a portion of the disclosure and are not to be understood as limiting the invention. Various substitutions, embodiments, and operation techniques will be apparent to those skilled in the art.

(A) While the first and second antenna supporting parts 19*a*, 20*a* are positioned on the boundary line between the engine compartment 13 and the equipment compartment 14 in the above embodiment, the present invention is not limited as such. That is, the first and second antenna supporting parts 19*a*, 20*a* may be disposed on the cab 16 or the steps 17.

(B) While the first and second antenna supporting parts 19*a*, 20*a* are positioned with left-right symmetry relative to the center line CL in the above embodiment, the present invention is not limited as such. The distance between the first antenna supporting part 19*a* and the center line CL may be different from the distance between the second antenna supporting part 20*a* and the center line CL. Further, both the first and second antenna supporting parts 19*a*, 20*a* may be disposed either on the left side or the right side of the center line CL.

(C) While the position furthest away from the revolving center CP of the steps 17 and the passage 18 is the left rear edge 18S of the passage 18 in the present embodiment, the present invention is not limited as such. The position furthest away from the revolving center CP of the steps 17 and the passage 18 may be within the steps 17. Further, since the shape of the passage 18 can be changed as necessary, the position furthest away from the revolving center CP in the passage 18 may be the front edge or a side edge of the passage 18.

(D) While the "machine compartment" is described as being constituted by the engine compartment 13 and the equipment compartment 14 in the above embodiment, the present invention is not limited as such. The "machine compartment" may be a structure disposed in front of the counterweight 12 and structures other than the engine compartment 13 and the equipment compartment 14 may be included therein.

(E) While the first and second antenna supporting parts 19*a*, 20*a* are respectively connected to the pair of handrails 19, 20 in the above embodiment, the present invention is not limited as such. The first and second antenna supporting parts 19*a*, 20*a* may be connected directly to the equipment compartment 14 and the like.

(F) While the first and second antenna supporting parts 19*a*, 20*a* are positioned to the rear of the first and second handrails 19, 20 in the above embodiment, the present invention is not limited as such. The first and second antenna supporting parts 19*a*, 20*a* may be respectively positioned in front of or beside the first and second handrails 19, 20.

(G) While the first and second antenna supporting parts 19*a*, 20*a* are described as being configured separately from the first and second handrails 19, 20 in the above embodiment, the first and second antenna supporting parts 19*a*, 20*a* may respectively be a portion of the first and second handrails 19, 20.

As described above, it is a matter of course that the present invention incorporates a variety of preferred embodiments which are not described herein. Hence the technical scope of the present invention is defined only by matters to define the invention, which are according to the scope of claims, reasonable from the above description.

What is claimed is:

1. A hydraulic excavator comprising:

a lower driving unit;

an upper revolving unit revolvably mounted on the lower driving unit about a revolving center;

a counterweight disposed on the upper revolving unit;

a machine compartment disposed in front of the counterweight on the upper revolving unit;

a cab disposed in front of the machine compartment on the upper revolving unit;

a passage formed on the machine compartment;

a plurality of steps connected to the machine compartment and leading to the passage; and a pair of antenna supporting parts configured to support a pair of antennas, the pair of antenna supporting parts being positioned ¼ or more of a vehicle width of hydraulic excavator from the revolving center, the pair of antenna supporting parts being positioned closer to the revolving center than a position furthest away from the revolving center of the passage and the steps as viewed from above.

2. The hydraulic excavator according to claim 1, wherein the antenna supporting parts are positioned on one of the machine compartment, the cab, and the steps as viewed from above.

3. The hydraulic excavator according to claim 2, further comprising:

a pair of handrails disposed on the machine compartment, the antenna supporting parts being connected to the handrails.

4. The hydraulic excavator according to claim 3, wherein the antenna supporting parts are positioned on a side opposite to the passage relative to the handrails as viewed from above.

5. The hydraulic excavator according to claim 2, further comprising:

a pair of handrails disposed on the machine compartment, the antenna supporting parts being a portion of the handrails.

6. The hydraulic excavator according to claim 2, further comprising:

a pair of antennas removably attached to the antenna supporting parts.

7. The hydraulic excavator according to claim 6, wherein the machine excavator includes an engine compartment disposed in front of the counterweight, and an equipment compartment disposed in front of the engine compartment, the passage being formed on the equipment compartment, and the steps being disposed in front of the equipment compartment.

8. The hydraulic excavator according to claim 2, wherein the machine excavator includes an engine compartment disposed in front of the counterweight, and an equipment compartment disposed in front of the engine compartment, the passage being formed on the equipment compartment, and the steps being disposed in front of the equipment compartment.

9. The hydraulic excavator according to claim 1, further comprising:

a pair of handrails disposed on the machine compartment, the antenna supporting parts being connected to the handrails.

10. The hydraulic excavator according to claim 9, wherein the antenna supporting parts are positioned on a side opposite to the passage relative to the handrails as viewed from above.

11. The hydraulic excavator according to claim 10, further comprising:

a pair of antennas removably attached to the antenna supporting parts.

12. The hydraulic excavator according to claim 10, wherein the machine excavator includes an engine compartment disposed in front of the counterweight, and an equipment compartment disposed in front of the engine compartment, the passage being formed on the equipment compartment, and the steps being disposed in front of the equipment compartment.

13. The hydraulic excavator according to claim 9, further comprising:

a pair of antennas removably attached to the antenna supporting parts.

14. The hydraulic excavator according to claim 9, wherein the machine excavator includes an engine compartment disposed in front of the counterweight, and an equipment compartment disposed in front of the engine compartment, the passage being formed on the equipment compartment, and the steps being disposed in front of the equipment compartment.

15. The hydraulic excavator according to claim 1, further comprising:

a pair of handrails disposed on the machine compartment, the antenna supporting parts being a portion of the handrails.

16. The hydraulic excavator according to claim 15, further comprising:

a pair of antennas removably attached to the antenna supporting parts.

17. The hydraulic excavator according to claim 15, wherein the machine excavator includes engine compartment disposed in front of the counterweight, and an equipment compartment disposed in front of the engine compartment, the passage being formed on the equipment compartment, and the steps being disposed in front of the equipment compartment.

18. The hydraulic excavator according to claim 1, further comprising:

a pair of antennas removably attached to the antenna supporting parts.

19. The hydraulic excavator according to claim 1, wherein the machine excavator includes an engine compartment disposed in front of the counterweight, and an equipment compartment disposed in front of the engine compartment, the passage being formed on the equipment compartment, and the steps being disposed in front of the equipment compartment.

* * * * *